US007785150B1

(12) United States Patent
Ho

(10) Patent No.: US 7,785,150 B1
(45) Date of Patent: Aug. 31, 2010

(54) BATTERY CONNECTOR

(75) Inventor: Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/467,249

(22) Filed: May 15, 2009

(51) Int. Cl.
*H01R 24/00* (2006.01)

(52) U.S. Cl. ..... 439/627

(58) Field of Classification Search ..... 439/627, 439/625, 660, 862, 500, 167
See application file for complete search history.

(56) References Cited

U.S. PATENT DOCUMENTS 7,517,261 B2 * 4/2009 Wan et al. ..... 439/862
7,575,468 B2 * 8/2009 Chien et al. ..... 439/500
7,632,153 B1 * 12/2009 Lai et al. ..... 439/660
2008/0268712 A1 * 10/2008 Wan et al. ..... 439/627
2009/0170374 A1 * 7/2009 Chu et al. ..... 439/627

* cited by examiner

*Primary Examiner*—Jean F Duverne

(57) ABSTRACT

A battery connector includes an insulating housing and a plurality of conductive terminals disposed in the insulating housing. The insulating housing defines a plurality of terminal recesses each extending longitudinally to penetrate through a bottom and a mating surface thereof. A top of each of the terminal recesses defines a locating passageway extending longitudinally. The conductive terminals are disposed in the corresponding terminal recesses. Each of the conductive terminals has a base board. A contact portion projects out of the mating surface of the insulating housing and an elastic portion elastically connects the contact portion to the base board. A portion of an edge of the elastic portion extends upward to form a locating portion slidably moving along the corresponding locating passageway so as to limit the movement area of the conductive terminal and avoid the conductive terminal swaying in the terminal recess.

8 Claims, 4 Drawing Sheets

BATTERY CONNECTOR

BACKGROUND OF THE INVENTION

1. Field of the Invention

The present invention relates to a connector, and more particularly to a battery connector.

2. The Related Art

A conventional battery connector used in a mobile phone or other portable electronic devices includes an insulating housing defining a plurality of terminal recesses therein, and a plurality of conductive terminals disposed in the respective terminal recesses. Each of the conductive terminals has a base board received in the corresponding terminal recess. An edge of the base board crookedly extends forward to form an elastic portion received in the corresponding terminal recess. A free end of the elastic portion extends forward to form a contact portion stretching out of the insulating housing for contacting a corresponding battery. When the battery connector is in use, the contact portion is pushed by the battery that makes the elastic portion compressed elastically.

However, the elastic portion of the conductive terminal easily sways around under the pushing of the battery without any locating structures. This leads the contact portion of the conductive terminal to sway around so that makes the connection between the battery connector and the battery unstable.

SUMMARY OF THE INVENTION

An object of the present invention is to provide a battery connector for contacting a battery. The battery connector includes an insulating housing and a plurality of conductive terminals disposed in the insulating housing. The insulating housing defines a plurality of terminal recesses each extending longitudinally to penetrate through a bottom and a mating surface thereof. A top of each of the terminal recesses defines a corresponding locating passageway extending longitudinally. The conductive terminals are disposed in the corresponding terminal recesses of the insulating housing. Each of the conductive terminals has a base board. A contact portion projects out of the mating surface of the insulating housing and an elastic portion elastically connects the contact portion to the base board. A portion of an edge of the elastic portion extends upward to form a locating portion slidably moving along the corresponding locating passageway so as to limit the movement area of the conductive terminal and avoid the conductive terminal swaying in the terminal recess.

As described above, the locating portion of the conductive terminal is slidably moving along the locating passageway of the insulating housing that can guide the elastic portion and the contact portion to move along a constant axis so as to avoid the conductive terminal swaying around in the terminal recess and further ensure a stable connection between the battery and the battery connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
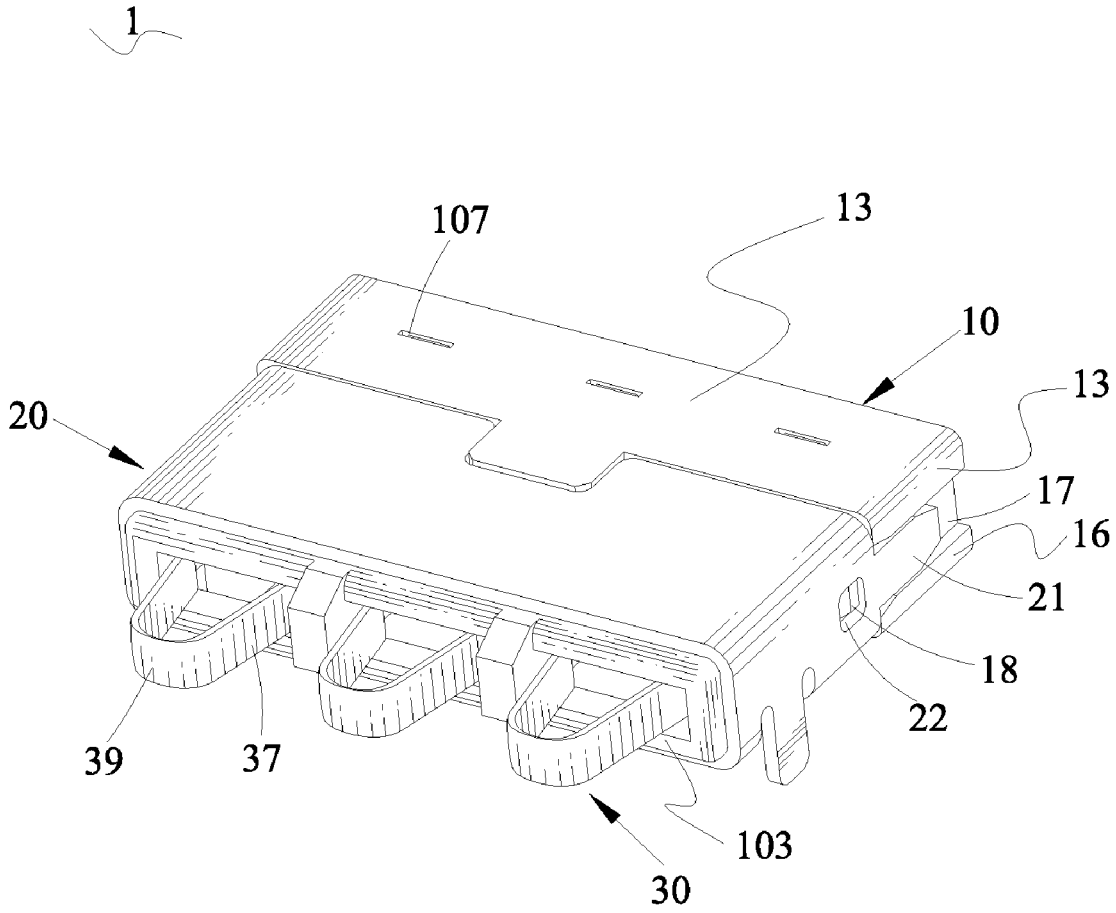
FIG. 1 is a perspective view of a battery connector in accordance with the present invention.

With reference to FIG. 1, a battery connector 1 in accordance with the present invention includes an insulating housing 10, a shell 20 and a plurality of conductive terminals 30 disposed in the insulating housing 10.

Figure 2:
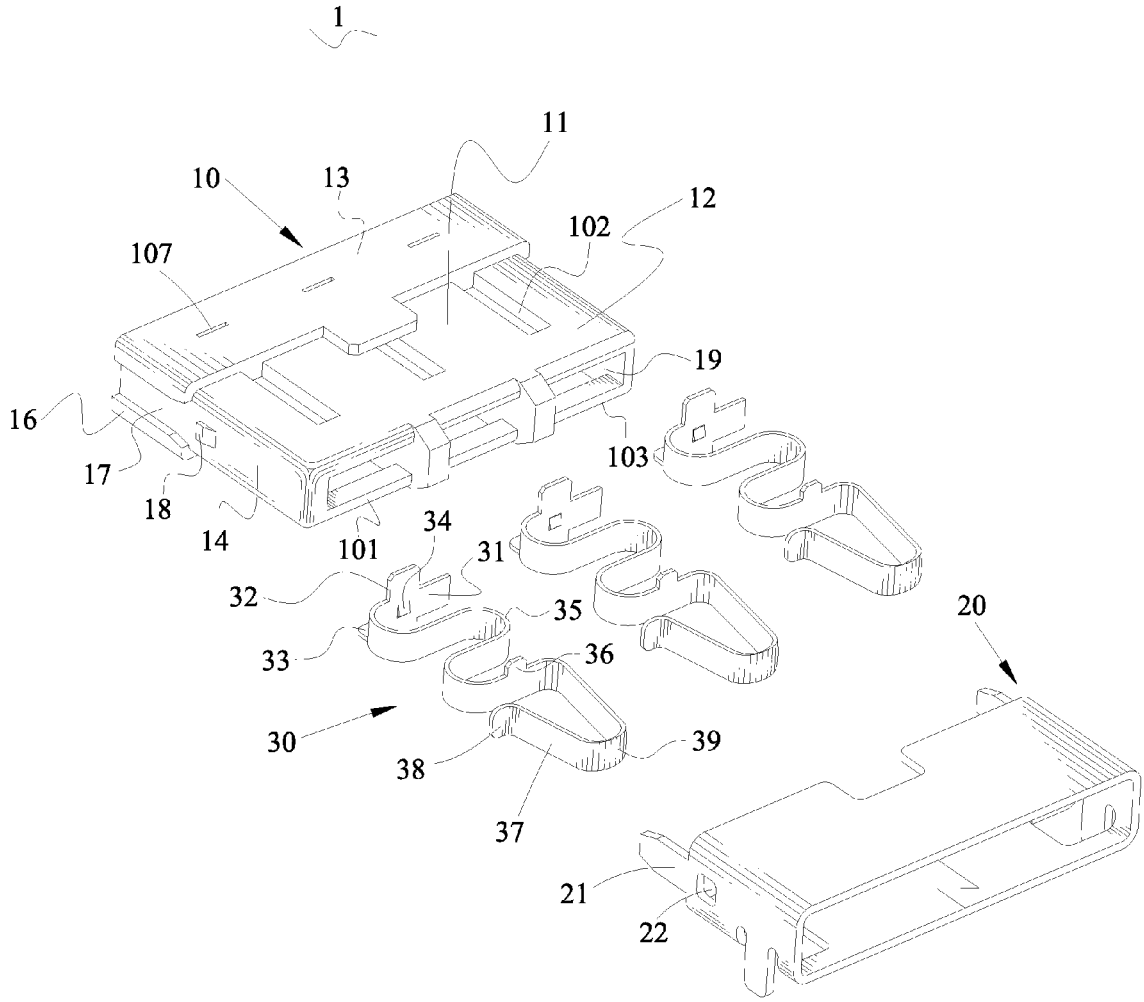
FIG. 2 is an exploded view of the battery connector of FIG. 1.
Figure 4:
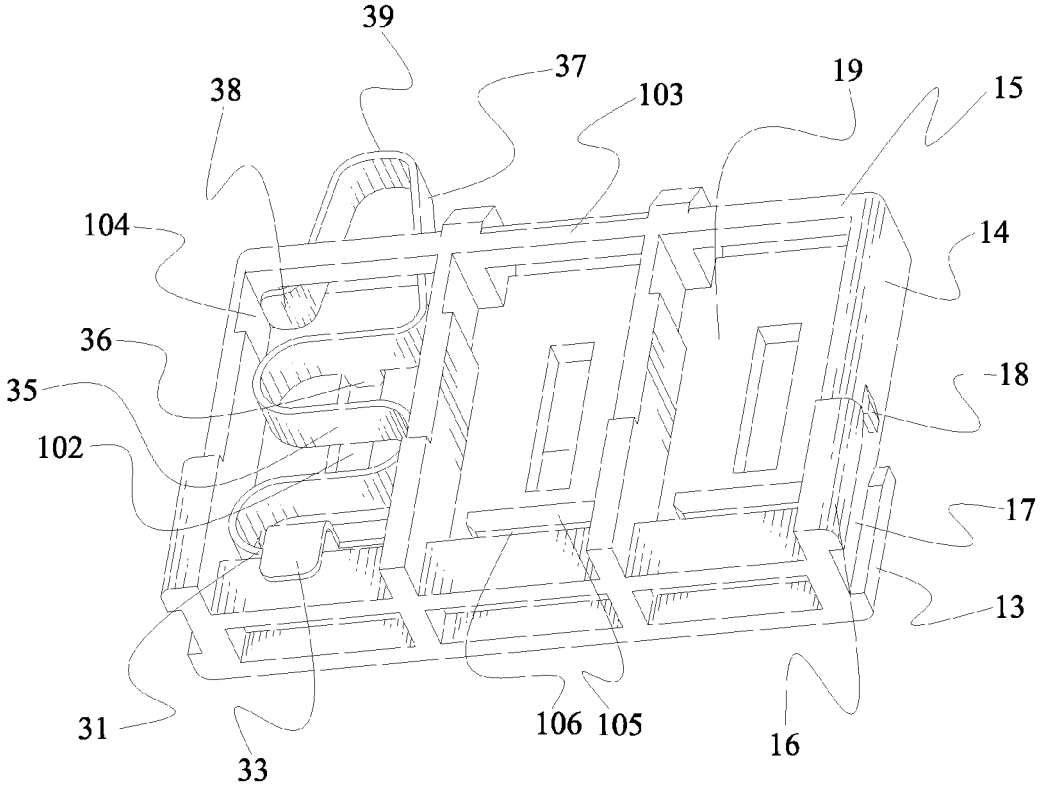
FIG. 4 is a perspective view of an insulating housing of the battery connector of FIG. 1, with one conductive terminal assembled therein.
Figure 5:
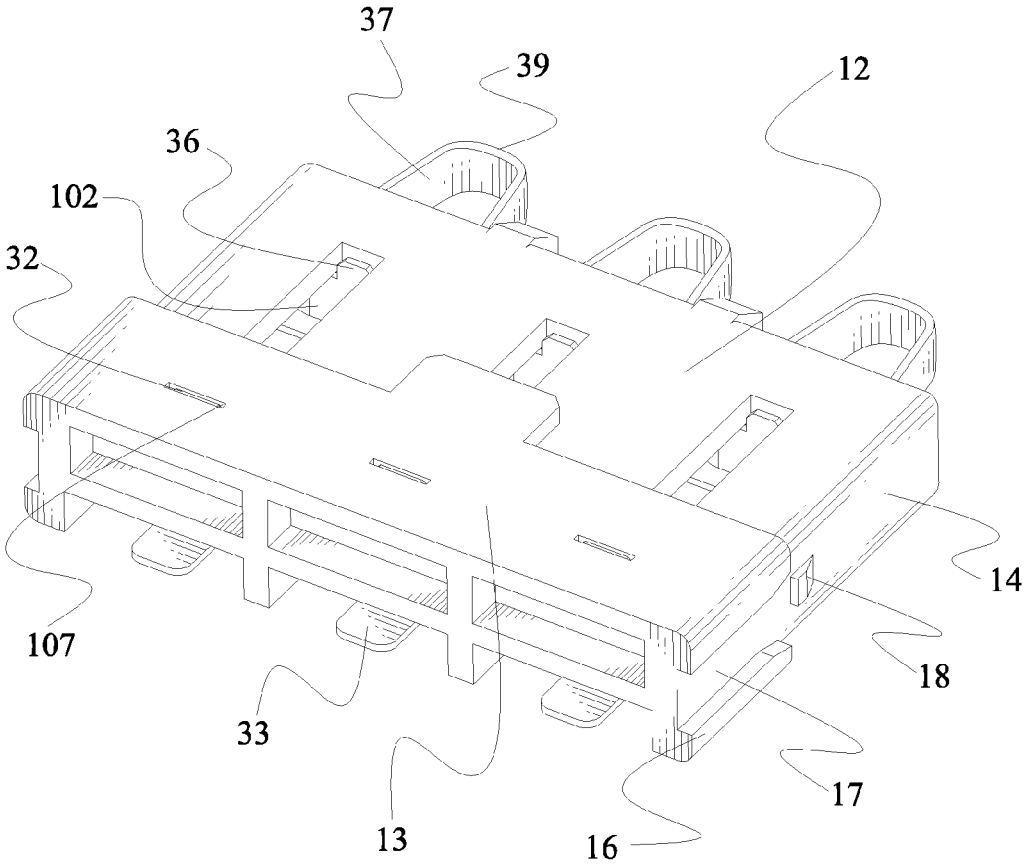
FIG. 5 is a perspective view of the battery connector of FIG. 1, without a shell.

Referring to FIG. 2 and FIG. 4, the insulating housing 10 has a base body 11 of rectangular shape. A rear part of a top surface 12 of the base body 11 protrudes upward to form a substantially rectangular stopping portion 13 extending transversely to reach to two opposite side surfaces 14 of the base body 11 and then being bent towards the two side surfaces 14 a little. The join of each side surface 14 and a bottom surface 15 of the base body 11 protrudes outward to form an L-shaped corner 16. Accordingly, a pair of holding grooves 17 is formed between two free ends of the stopping portion 13 and the corresponding corners 16. Each of the side surfaces 14 of the base body 11 protrudes outward to form a holding lump 18 spaced away from the corresponding holding groove 17. The base body 11 defines a plurality of rectangular terminal recesses 19 arranged at regular intervals along a transverse direction thereof and each extending longitudinally to penetrate through a front mating surface 101 and the bottom surface 15 thereof. A middle of each of the terminal recesses 19 extends upward to form a locating passageway 102 extending longitudinally to a front edge of the stopping portion 13 and passing through the top surface 12 of the base body 11. A supporting beam 103 is formed in a front of a bottom of the terminal recess 19 to connect two opposite sides of the terminal recess 19. The front of the terminal recess 19 extends sideward to form a position notch 104, and a top side thereof protrudes downward into the terminal recess 19 to form a preventing board 105 adjacent to a rear wall of the terminal recess 19. A fixing channel 106 is formed between the preventing board 105 and the rear wall of the terminal recess 19. A middle of the fixing channel 106 further extends upward to penetrate through the stopping portion 13 to form an inserting slot 107.

Referring to FIG. 2 again, the shell 20 is of oblong shape by a front view. Two opposite sides of the shell 20 extend rearward to form a pair of holding sections 21 facing each other. The two opposite sides of the shell 20 further define a pair of holding apertures 22 passing therethrough and facing each other.

Figure 3:
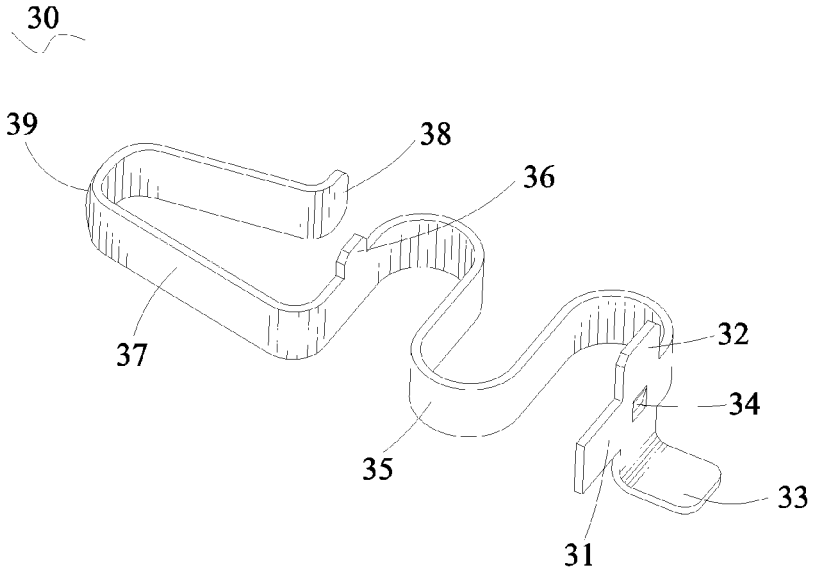
FIG. 3 is a perspective view of a conductive terminal of the battery connector of FIG. 1.

Referring to FIG. 2 to FIG. 3, each of the conductive terminals 30 has a base board 31 of rectangular shape. A top edge of the base board 31 extends upward to form an inserting portion 32. A bottom edge of the base board 31 extends downward and is perpendicularly bent to form a soldering portion 33. The base board 31 protrudes outward to form a fixing barb 34. An end edge of the base board 31 extends towards an opposite direction to the soldering portion 33 to form an elastic portion 35 with a substantially serpentine shape. A top edge of a front of the elastic portion 35 extends upward to form a locating portion 36. A free end of the elastic portion 35 further extends to form a contact portion 37 of lying-V shape with an opening facing the elastic portion 35. A free end of the contact portion 37 is bent outward to form a propping portion 38. The bent portion of the contact portion 37 is defined as a contact point 39.

Referring to FIG. 1 to FIG. 5, in assembly, the elastic portion 35 of each of the conductive terminals 30 is disposed in the corresponding terminal recess 19 of the insulating housing 10. The contact portion 37 stretches out of the mating surface 101 of the insulating housing 10 for contacting a battery (not shown) by means of the contact point 39 and is supported by the supporting beam 103. The propping portion 38 is positioned in the corresponding position notch 104 for restraining the contact portion 37. The locating portion 36 is slidably moving along the locating passageway 102 so as to limit the movement area of the conductive terminal 30. The base board 31 is fixed in the corresponding fixing channel 106, and the fixing barb 34 abuts against an inner surface of the fixing channel 106. The inserting portion 32 is inserted into the inserting slot 107 so as to fasten the conductive terminal 30 in the insulating housing 10 firmly. The soldering portion 33 is exposed from the bottom of the insulating housing 10 for being soldered with a printed circuit board (not shown). The shell 20 encloses a front portion of the base body 11 of the insulating housing 10. The holding sections 21 of the shell 20 are inserted in the corresponding holding grooves 17 of the insulating housing 10 and the holding lumps 18 are buckled into the corresponding holding apertures 22 so as to form a firm engagement between the insulating housing 10 and the shell 20. The front edge of the stopping portion 13 of the insulating housing 10 is against a rear edge of the shell 20.

In use, the contact portion 37 of each of the conductive terminals 30 is pushed by the battery towards the respective terminal recess 19 that makes the elastic portion 35 compressed elastically along a constant axis on account of the locating portion 36 restrained in the locating passageway 102 so that ensure a stable connection between the contact point 39 and the battery. When the battery is taken out from the battery connector 1, the elasticity of the elastic portion 35 is set free to push the contact portion 37 to move outward until the propping portion 38 is restrained. At this time, the locating portion 36 is also restrained by a front edge of the corresponding locating passageway 102.

As described above, the locating portion 36 of the conductive terminal 30 is slidably moving along the locating passageway 102 of the insulating housing 10 that can guide the elastic portion 35 and the contact portion 37 to move along the constant axis so as to avoid the conductive terminal 30 swaying around in the terminal recess 19 and further ensure a stable connection between the battery and the battery connector 1.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A battery connector, comprising:

an insulating housing defining a plurality of terminal recesses each extending longitudinally to penetrate through a bottom and a mating surface thereof, a top of each of the terminal recesses defining a corresponding locating passageway extending longitudinally; and a plurality of conductive terminals disposed in the corresponding terminal recesses of the insulating housing, each of the conductive terminals having a base board, a contact portion projecting out of the mating surface of the insulating housing and an elastic portion elastically connecting the contact portion to the base board, a portion of an edge of the elastic portion extending upward to form a locating portion slidably moving along the corresponding locating passageway so as to limit the movement area of the conductive terminal and avoid the conductive terminal swaying in the terminal recess.

2. The battery connector as claimed in claim 1, wherein the elastic portion is of serpentine shape and the contact portion is of lying-V shape with an opening facing the elastic portion.

3. The battery connector as claimed in claim 2, wherein each of the terminal recesses extends sideward to form a position notch, a free end of the contact portion defines a propping portion positioned in the corresponding position notch for restraining the contact portion.

4. The battery connector as claimed in claim 1, wherein a supporting beam is formed in a bottom of the terminal recess to connect two opposite sides of the terminal recess for supporting the contact portion.

5. The battery connector as claimed in claim 1, wherein a preventing board is protruded into the respective terminal recess of the insulating housing, a fixing channel is formed between the preventing board and a rear wall of the terminal recess for fastening the base board of the respective conductive terminal therein.

6. The battery connector as claimed in claim 5, wherein the base board of each of the conductive terminals further protrudes to form a fixing barb abutting against an inner surface of the fixing channel.

7. The battery connector as claimed in claim 5, wherein each of the fixing channels further extends upward to form an inserting slot, a top edge of the base board extends upward to form an inserting portion inserted into the corresponding inserting slot.

8. The battery connector as claimed in claim 1, further comprising a shell enclosing the insulating housing, two opposite sides of the shell extending rearward to form a pair of holding sections, the two opposite sides of the shell further defining a pair of holding apertures, each side surface of the insulating housing defining a holding groove for fastening the corresponding holding section therein, and protruding outward to form a holding lump buckled into the corresponding holding aperture.

* * * * *